United States Patent [19]

Stine

[11] Patent Number: 4,820,194

[45] Date of Patent: Apr. 11, 1989

[54] MINATURE ELECTRICAL SHUNT CONNECTOR

[75] Inventor: Jon D. Stine, Elizabethtown, Pa.

[73] Assignee: AMP Incorporated, Harrisburg, Pa.

[21] Appl. No.: 103,233

[22] Filed: Sep. 30, 1987

[51] Int. Cl.[4] ..... H01R 31/08

[52] U.S. Cl. ..... 439/510; 439/723; 439/787

[58] Field of Search ..... 439/188, 500, 507–513, 439/723, 724, 729, 744, 746, 747, 786, 787, 796, 816, 834, 842, 856, 857

[56] References Cited

U.S. PATENT DOCUMENTS

| | | | |
|---|---|---|---|
| 2,740,097 | 3/1956 | Edelman et al. | 439/786 |
| 3,208,030 | 9/1965 | Evans et al. | 439/747 |
| 3,874,769 | 4/1975 | Simon | 439/723 |
| 4,383,724 | 5/1983 | Verhoeven | 339/19 |
| 4,482,198 | 11/1984 | Crowley | 339/19 |
| 4,533,202 | 8/1985 | Pohl | 439/391 |
| 4,602,834 | 7/1986 | Hahn et al. | 339/19 |
| 4,607,899 | 8/1986 | Romine et al. | 339/19 |

FOREIGN PATENT DOCUMENTS

| | | | |
|---|---|---|---|
| 402992 | 6/1966 | Switzerland | 439/842 |

OTHER PUBLICATIONS

"Connector", IBM Tech. Disclosure Bulletin, J.M. Cioffi, vol. 8, No. 10, p. 1327.

AMP Deutschland Dwg. No. 826 853 (Confindential Information Blanked Out).

AMP Do Brasil Dwg. No. 880584 (Confidential Information Blanked Out).

AMP Do Brasil Product Bulletin B 86-001, "AMP NOVO Shunt, P.N. 880584", 8/86, AMP Do Brasil, Sao Paolo, Brazil.

AMP Data Sheet, 80-603, "AMP Shunts", 6/81, AMP Incorporated, Harrisburg, PA., pp. 1–4.

Molex Product Catalog, p. 102A.

Elco Product Bulletin, Publ. No. C-094, "EL-BIT Switch Connector Series 8261", Elco Corporation, Huntingdon, PA.

Elco Product Bulletin, Publ. No. C-095, "Mini-Bit Switching Connector Series 9067", Elco Corporation, Huntingdon, PA.

Connectral Product Catalog, pp. 17—18, "Shunts to a Pitch of 2, 54 mm", Connectral, Suresnes, France.

Honda Product Bulletin, "Honda Connector DIC Series", Honda Tsushin Kogyo Co., Ltd., Tokyo, Japan.

*Primary Examiner*—David Pirlot

*Attorney, Agent, or Firm*—Anton P. Ness

[57] ABSTRACT

A miniature low-profile shunt connector (10) for one or more than one pair of terminal posts (20) of a post array includes a housing member (12) having at least one shunt-receiving cavity (16), and at least one shunt member (14) formed of a continuous length of wire having spring characteristics. The formed wire shunt (14) has a central portion (36) consisting of a pair of leg sections (38) extending rearwardly from a large bight (40) at the front of the cavity (16), and end sections (46) extending forwardly from rear bights (44) joining them to respective leg sections (38). Free ends (48) of the end sections (46) are disposed behind stop surfaces (28) near the front of the cavity (16) to retain the formed wire shunt (14) therewithin. Near the mating face (18) each pair of end and leg sections (46,38) form a constriction at contact sections (50,42) to engage a respective terminal post (20) received therebetween, and the end section (46) is deflected outwardly and acts like a spring arm providing contact normal force against the post. Surfaces of the formed wire shunt (14) which engage the post (20) are formed by wire extrusion and are smooth and free of surface irregularities assuring adhesion of plating material and minimizing post damage.

8 Claims, 1 Drawing Sheet

FIG. 1
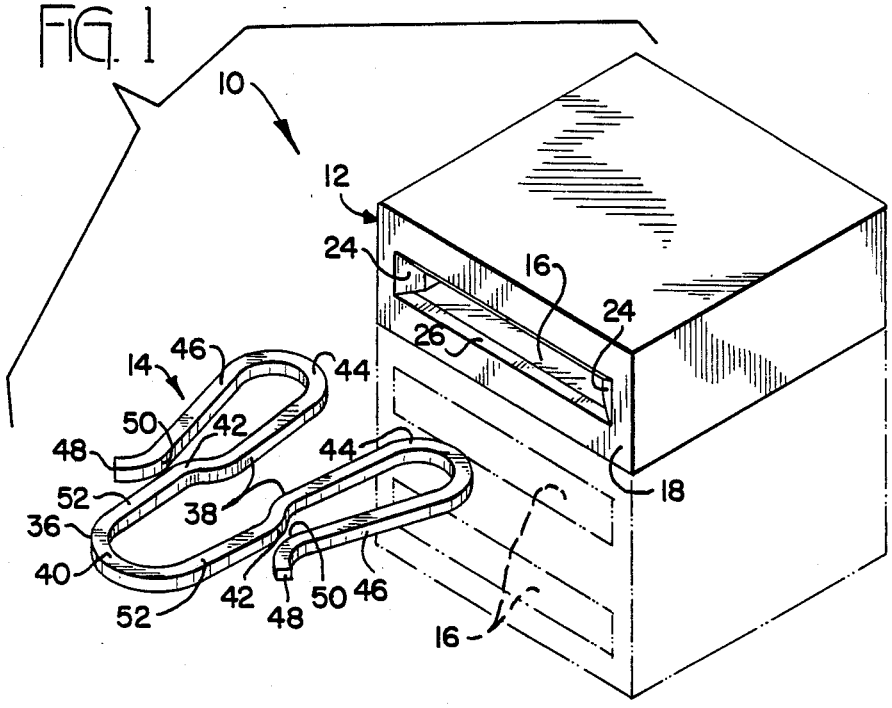
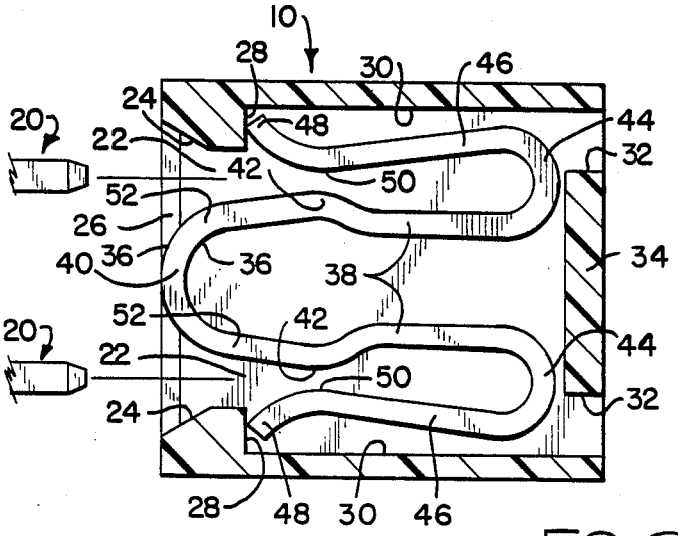
FIG. 2

MINATURE ELECTRICAL SHUNT CONNECTOR

FIELD OF THE INVENTION

This relates to the field of electrical connectors and more particularly to connectors for terminal posts.

BACKGROUND OF THE INVENTION

Shunt connectors are known which electrically connect a pair of adjacent terminal posts of a post array to allow commoning therebetween. One such shunt connector is disclosed in U.S. Pat. No. 4,726,787 assigned to the assignee hereof; it comprises an integral stamped metal part contained in a dielectric housing. The shunt connector is of a miniature size and is said to have an axial length of only about 0.2 inches, a width of just less than 0.200 inches and a height of just less than 0.100 inches to permit side-by-side and vertical stacking with other like shunt connectors on an array of terminal posts on 0.100 inch centerlines in rows 0.100 inches apart. The metal shunt insert is substantially planar and consists of two coplanar pairs of cantilever beams joined at a rearward body section, and the shunt is inserted into a cavity of a low-profile housing from the mating face thereof. The adjacent inner shunt beams include projections or barbs struck outwardly from the plane of the shunt which latch behind a latching aperture within the front of the housing upon full shunt insertion to retain the shunt within the housing. The pairs of cantilever beams are disposed along and on each side of centerlines of the post-receiving cavity portions and are adapted to be deflected apart within the plane of the shunt by respective terminal posts entering the shunt connector along the centerlines. However, the post-engaging opposed contact surfaces of each pair of cantilever beams are sheared edges which include surface irregularities resulting from the shearing process, and also burrs which would be difficult or expensive to remove by deburring especially in such a small metal part. It is undesirable that such burrs bear agaisnt the terminal posts which could damage at least the plating material of the terminal posts which could be for example only 0.025 inches square in cross-section, or even example only 0.025 inches square. Further, it is considered undesirabe for contact surfaces to have even microscopic surface irregularities resulting from shearing because such irregularities adversely affect adhesion of plating material used to plate the contact surfaces to provide for a satisfactory electrical engagement with a mating contact surface over a long period of time.

It is desired to provide a miniature low-profile shunt connector wherein the opposed contact surfaces engageable with terminal posts inserted there between do not damage the plating material of the posts.

It is also desired to provide contact surfaces free of surface irrgularities and thereby enhance adhesion thereto of plating material plated thereon.

It is further desired to provide a shunt connector whose small sized parts have simpler structures simplifying manufacture, while providing for assured retention of the shunt member within the housing and for sufficient contact normal force with terminal posts.

It is yet further desired to provide a shunt member and associated housing cavity for a miniature low-profile shunt connector wherein all sections thereof are disposed within a common plane along with the means to retain the shunt member within the housing cavity to facilitate close spacing with an adjacent like shunt member in an adjacent like cavity.

SUMMARY OF THE INVENTION

The miniature low-profile shunt connector of the present invention includes an integral metal insert formed of a length of wire and inserted into a cavity of a dielectric housing. Preferably the shunt if formed from wire having a rectangular cross-section, and those surface portions which will be contact surfaces and are therefore plated, will be extruded flat surfaces instead of sheared edges. The formed wire shunt includes two coplanar pairs of inner and outer contact sections, each pair receiving therebetween a respective terminal post, and all sections of the shunt are disposed in a common plane. The outer contact section of each pair consists of an inwardly extending arcuate section of a spring arm defined by an end section of the wire shunt. The inner contact section of each pair consists of a corresponding inwardly extending arcuate section along a length of the wire joined at a respective rear bight section to the associated spring arm, and the inner contact sections are joined to each other at a front bight section of the wire shunt. The pairs of inwardly extending arcuate contact sections are spaced apart a distance less than the width of an associated terminal post receivable therebetween, so that upon insertion the terminal post deflects the opposing contact sections apart generating sufficient normal force to assure an appropriate electrical connection therebetween.

In one aspect of the present invention the free end of each spring arm is directed outwardly to engage behind a respective rearwardly facing stop surface of the adjacent housing side wall proximate the forward end of the cavity, defining a means for retaining the wire shunt within the cavity where the retention means is disposed within the plane of the wire shunt.

In another aspect of the present invention the front bight section of the wire shunt is disposed centrally of the housing cavity along the mating face and extends forwardly to the mating face to perform a lead-in function for a pair of terminal posts inserted into the shunt connector, in cooperation with tapered lead-in surfaces of the housing at the outer ends of the cavity, so that the housing need not provide lead-in surface portions between the post-receiving areas for each terminal post of the pair and the miniature housing structure is thereby simplified.

It is an objective of the present invention to provide an integral shunt member of a miniature shunt connector which presents engagement surfaces free of burrs to the terminal posts being commoned therbey, to minimize damage to the plating material on the post, without subjecting the shunt member to a deburring process.

It is an additional objective to provide a shunt member having contact surfaces which are not sheared mating edges but which are extruded surfaces free of surface irregularities, thereby enhancing adhesion thereto of plating material thereon.

It is a further ojbective to provide a such a shunt member which includes means for retaining itself within a respective cavity, which means are disposed within the plane of the shunt, and wherein such means do not interfere with deflection of spring arms thereof during post reception.

It is yet a further objective to provide a shunt member which provides lead-in benefits for receiving the posts into the shunt connector and thereby enable simplification of the housing structure at the cavity entrance.

BRIEF DESCRIPTION OF THE DRAWINGS

FIG. 1 is a perspective view of the formed wire shunt insert of the present invention exploded from the housing; and FIG. 2 is a sectioned plan view of the assembled shunt connector to receive a pair of posts.

DETAILED DESCRIPTION OF THE PREFERRED EMBODIMENT

Shunt connector 10 comprises a housing 12 and a formed wire shunt member 14 which is inserted into a cavity 16 of housing 12 from forwardly of mating face 18 thereof. Housing 12 can be either a single cavity housing, or it can be a multiple cavity housing for a plurality of shunt members 14. A pair of terminal posts 20 such as of a post array are receivable into post-receiving cavity portions 22 spaced a selected distance apart proximate lateral ends of a cavity 16 connector 10, to be commoned by shunt member 14. Posts 20 to be commoned can be disposed along centerlines 0.100 inches apart within a given row, and shunt connector 10 can have a height less than 0.100 inches and a width of less than 0.200 inches, to enable stacking of a plurality of like shunt connectors on the post array, and can further have an axial length of about 0.225 inches to maintain a low profile on the array.

Housing 12 is an integral member which can be molded of a thermoplastic resin such as polyester, and each cavity 16 thereof has a wide entrance along mating face 18 with tapered lead-in surfaces 24 at opposed lateral ends of the entrance and tapered lead-in surfaces 26 along the top and bottom of the entrance. Lead-in surfaces 24, 26 facilitate insertion of shunt member 14 into housing cavity 16 and reception of terminal posts 20 into connector 10. Within cavity 16 are defined rearwardly facing stop surfaces 28 at sides 30 thereof proximate mating face 18, with corresponding apertures 32 along rear housing wall 34 fored by core pins during the molding of stop surfaces 28.

Shunt member 14 is formed of an integral length of wire such as of beryllium copper alloy or phosphor bronze and having a preferably rectangular cross-section having dimensions for example of 0.018 inches in the vertical direction, and 0.010 in the horizontal direction which is in the plane of the shunt. Central portion 36 comprises a pair of leg sections 38 extending rearwardly from a large front bight 40, and along each leg section 38 near the front is an outwardly projecting arcuate region defining an inner contact section 42. At the rear end of shunt member 14 are rear bights 44 each joining a respective leg section 38 to an end section 46 of the length of wire extending forwardly from the rear bights to free ends 48. Each end section 46 first converges toward the associated leg section 38, and then diverges to free end 48, to form an arcuate outer contact section 50 opposed from inner contact section 42. Each pair of outer and inner contact sections 50, 42 together comprise a constriction having a dimension smaller than the width of a terminal post 20 inserted therebetween to establish sufficient electrical engagement therewith. Shunt member 14 is preferably plated at least at the contact sections such as by gold over nickel.

Upon insertion of shunt member 14 into housing cavity 16, rear bights 44 are temporarily deflected toward each other by lead-in surfaces 24 to pass by the lateral ends of the cavity entrance. Outwardly angled free ends 48 are similarly deflected toward each other during insertion, and upon full insertion resile to be disposed behind stop surfaces 28 to retain shunt member 14 within housing 12. After insertion free ends 48 maintain a spacing from cavity sides 30 to permit end sections 46 to be deflected laterally outwardly by a terminal post 20 and thus to constitute spring arms. Free ends 48 are disposed within the plane of the shunt member enabling the shunt member and the cavity to have a minimal height, which in turn enables vertical spacing of adjcent shunt members in associated adjacent cavities to be reduced, so that the shunt member spacing in the present invention can be 0.050 inches, or just less than that for discrete single cavity housings, for an array of terminal posts having rows only 0.050 inches apart.

Leg sectios 38 join front bight 40 proximate mating face 18 at portions 52 which are slightly angled toward each other and which constitute lead-in means opposing nd cooperating with housing lead-in surfaces 24 to facilitate receipt of terminal posts 20 into shunt connector 10. Such a lead-in benefit provided by the shunt member itself eliminates the need for lead-in suface portions to be provided by the housing centrally along the cavity entrance between a pair of terminal posts.

The surfaces of shunt member 14 which can engage a portion of a terminal post 20 are formed by extrusion of the rectangular wire and are free of burrs which commonly result from forming such edges by shearing which minimizes the possibility of damaging the plating material, commonly gold over nickel, on the contact surfaces of the post. The smooth flat surfaces of the wire shunt resulting from the wire extrusion process are free of the surface irregularities commonly resulting from a conventional shearing process, and the smoothness improves the adhesion of plating material on the contact surfaces of the shunt member, and thereby improves long-term corrosion resistance. The formed wire shunt thus eliminates, in addition to a deburring process, the need for using a more elaborate, more expensive plating process otherwise needed to plate a sheared edge, or alternatively the need for a more elaborate, more expensive microshearing process or finishing process to achieve an appropriately smooth base metal surface. The formed wire shunt member and the housing member of the present invention are very small articles which have a relatively simple geometry for ease of manufacture and assembly together, and the shunt member easily self-retains within the housing in a manner which permits spring biased engagement of its contact sections with a terminal post for assured electrical engagement.

While the particular shunt member and housing disclosed above together represent the preferred embodiment of the present invention, variations may be made thereto which are within the spirit of the invention and the scope of the claims.

What is claimed is:

1. A miniature electrical shunt connector for commoning of adjacent terminal posts of at least one pair of posts of a post array, comprising:

housing means having at least one cavity extending rearwardly from an entrance at a mating face to a rear wall thereof;

at least one shunt member disposed in a respective said cavity; and means for retaining each said shunt member in a respective said cavity, each said shunt member being essentially disposed in a plane having a thickness substantially equal to the diameter of terminal posts with which it is to shunt, and each said shunt member having a central portion and end sections, said central portion including leg sections joined to and extending rearwardly from a large front bight, said end and leg sections being associated in pairs and joined to and coextending forwardly from respective rear bights to receive respective terminal posts therebetween, said end section and leg section of each said pair converging toward each other proceeding forwardly from said respective rear bight to a respective constriction and curving outwardly forwardly thereof defining a pair of outer and inner contact sections at said constriction engageable with a respective terminal post received therebetween, each said constriction being smaller than the dimension of the terminal post so that said outer and inner contact sections establish an assured electrical connection therewith, and said shunt member being adapted so that said end and leg sections of each said pair are simultaneously relatively urgeable apart at said constrictions by respective said terminal posts received simultaneously therebetween, and each said shunt member being formed of a length of extruded wire having spring characteristics whereby the surfaces of said shunt member engaging a terminal post are formed by extrusion and are smooth and substantially free of surface irregularities to enhance adhesion of plating material thereto and to minimize damage to the post.

2. A miniature electrical shunt connector as set forth in claim 1 wherein said housing means is a housing member having a plurality of said cavities each having a said shunt member disposed therein to common a like plurality of pairs of terminal posts.

3. A miniature electrical shunt connector as set forth in claim 1 wherein said housing means is a housing member having one said cavity having a said shunt member therein to common one pair of terminal posts.

4. A miniature electrical shunt connector as set forth in claim 1 wherein said extruded wire is rectangular in cross-section.

5. A miniature electricalshunt connector as set forth in claim 4 wherein the dimension of said extruded wire in the direction transverse to the plane of said shunt member is greater than the dimension in the plane thereof.

6. A miniature electrical shunt connector as set forth in claim 1 wherein said housing means includes rearwardly facing stop surfaces along sides of each said cavity proximate said entrance, said entrance includes tapered lead-in surfaces at least at opposing sides thereof, each said end section concludes at an outwardly angled free end, and each said shunt member being insertable into a respective said cavity of said housing means through said cavity entrance with said rear bights and then outwardly angled free ends of said end sections being deflectable inwardly at said cavity entrance to permit insertion, said free ends thereafter resiling to be disposed behind said stop surfaces to retain said shunt member within said cavity, whereby said means for retaining said shunt member within said cavity and all portions of said shunt member are disposed in a common plane to enable close spacing with an adjacent like shunt member in an adjacent like cavity where the rows of terminal posts of the post array are closely spaced.

7. A miniature electrical shunt connector as set forth in claim 6 wherein said free ends are spaced from said cavity sides to permit outward deflection of said end sections upon receipt of respective said terminal posts between rspective said associated outer and inner contact sections.

8. A miniature electrical shunt connector as set forth in claim 6 wherein said leg sections join said front bight at portions angled outwardly from respective said constrictions and forwardly thereof to define lead-in means opposed from and cooperable with said lead-in surfaces at opposed ends of said cavity entrance after assembly to facilitate receipt of respective terminal posts thereinto.

* * * * *